United States Patent [19]

McBee

[11] Patent Number: 4,555,929

[45] Date of Patent: Dec. 3, 1985

[54] DOOR HINGE ALIGNING TOOL AND METHOD

[76] Inventor: Gerald McBee, 793 W. Tamarack, Hermiston, Oreg. 97838

[21] Appl. No.: 512,792

[22] Filed: Jul. 25, 1983

[51] Int. Cl.[4] ..... B21J 13/08

[52] U.S. Cl. ..... 72/458; 29/243.5; 72/479

[58] Field of Search ..... 72/458, 459, 457, 479, 72/705, 477; 81/3 R, 177 R, 177.8; 29/283.5, 243.5; D8/88

[56] References Cited

U.S. PATENT DOCUMENTS

| | | | |
|---|---|---|---|
| 120,304 | 10/1871 | McBride | 81/177.8 |
| 283,675 | 8/1883 | Sherman | 81/177 R |
| 1,326,907 | 1/1920 | Bond | 72/458 |
| 1,344,533 | 6/1920 | Cole | 72/458 |
| 2,641,946 | 6/1953 | Phipps | 72/477 |
| 2,772,587 | 12/1956 | Woodring et al. | 81/15 |
| 3,332,274 | 2/1965 | Dunster, Jr. | 72/458 |
| 3,902,350 | 9/1975 | McManus | 72/479 |
| 3,965,720 | 6/1976 | Goodwin et al. | 72/458 |

FOREIGN PATENT DOCUMENTS

| | | | |
|---|---|---|---|
| 2268599 | 11/1975 | France | 81/177 R |

OTHER PUBLICATIONS

"The Strongest Bumper Bracket Tool on the Market," article on p. 25 of, *Autobody and the Reconditioned Car,* vol. XLVIII, No. 2, Feb. 1969.

*Primary Examiner*—Lowell A. Larson
*Assistant Examiner*—Linda McLaughlin
*Attorney, Agent, or Firm*—Klarquist, Sparkman, Campbell, Leigh & Whinston

[57] ABSTRACT

A method of aligning a sprung vehicle door without removing the door from its hinge and door frame comprises opening the vehicle door, positioning a prying tool having a head means for engaging the hinge between the door and door frame, engaging a portion of the hinge in the head means, and rotating the tool in a direction of closure of the door so as to bend one of the hinge and door frame to a predetermined alignment position. A vehicle door aligning tool for carrying out the aforementioned method comprises a specialized form of handle and head member. The handle is arranged to extend laterally behind the vehicle door when the head member is fitted on the hinge. The handle includes an elongated handle portion and a relatively much shorter end portion obtusely angled from the handle portion. The head member is J-shaped to define a channel normal to the handle portion for receiving an exposed margin or flange of a vehicle door hinge mount to rigidly engage the hinge mount.

3 Claims, 4 Drawing Figures

FIG. 2
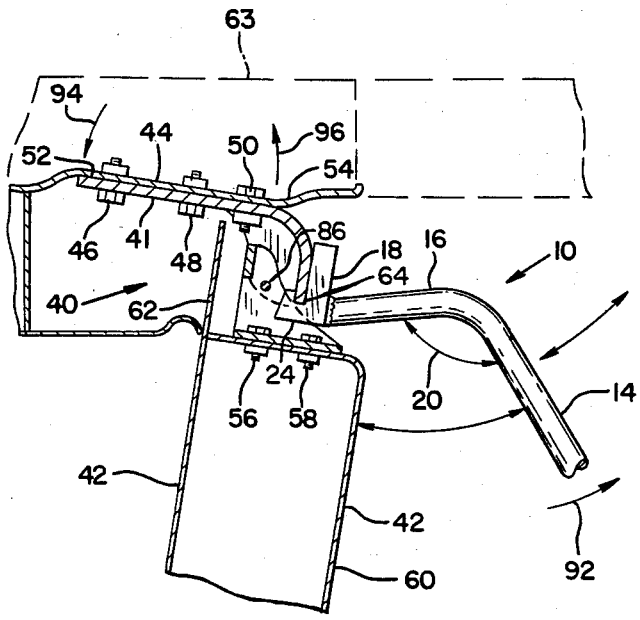
FIG. 1
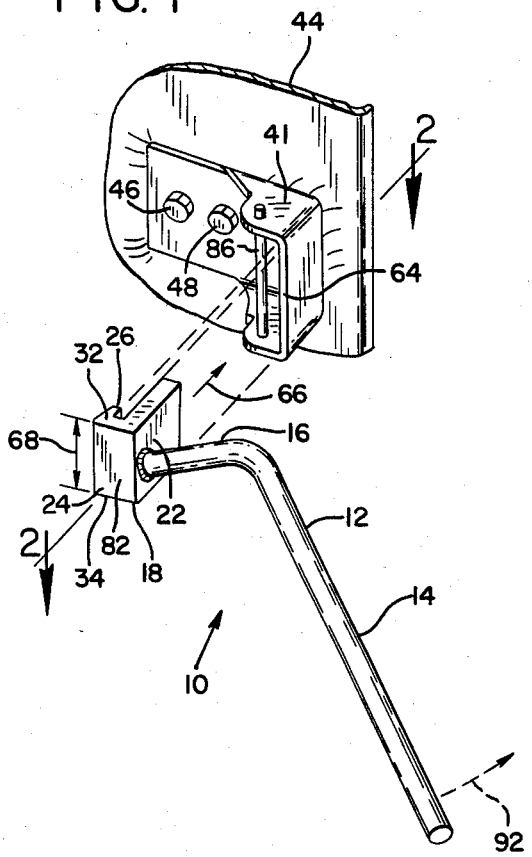
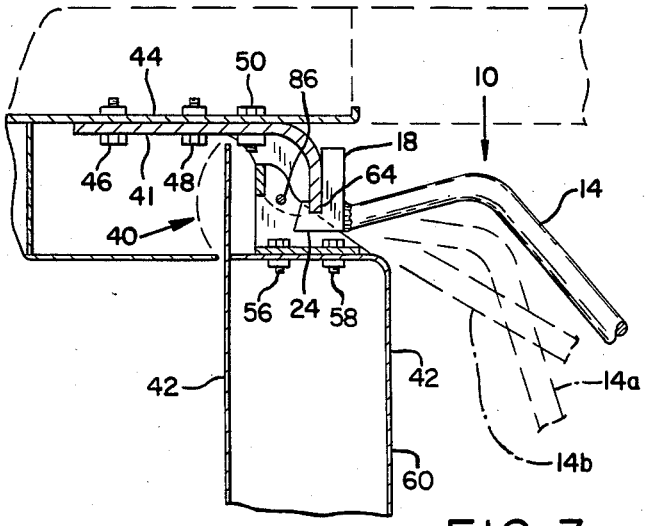
FIG. 3
FIG. 4
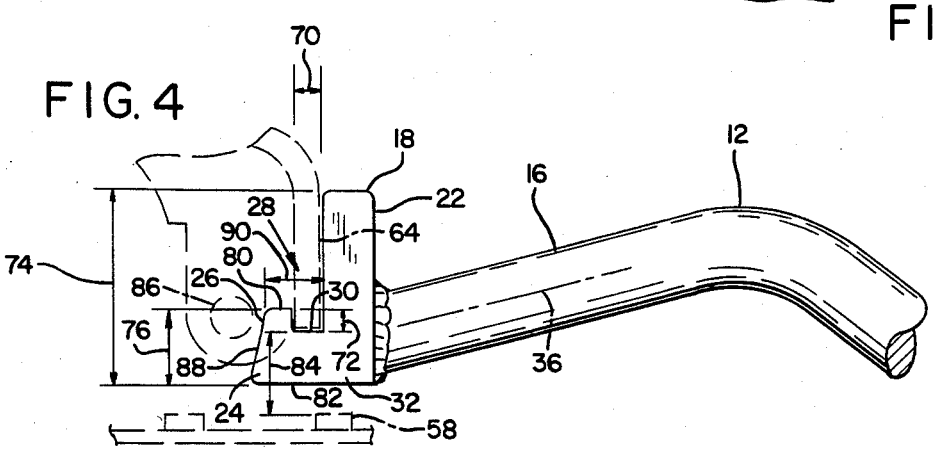

DOOR HINGE ALIGNING TOOL AND METHOD

BACKGROUND OF THE INVENTION

This invention relates generally to door hinge alignment tools and methods, and more particularly to a tool and method for aligning sprung vehicle doors.

When the door of a vehicle is opened too far, such as when caught by the wind, the door hinge and door frame can be sprung to the point where the door will not close properly, if at all. For the door to close properly, it is necessary to bend the hinge or door frame or both back to their original, intended shape and relationship. This can be an arduous process, requiring partial disassembly and removal of the door to obtain access to the bent members.

In the drawing, FIG. 2 shows a horizontal sectional view downwardly through the hinge of the left door of a General Motors pick-up truck in which the door has been sprung by being opened too far. When this happens, the panel on which the hinge is mounted is often bent inwardly at the front or left end of the hinge mount and pulled outwardly at the back or right end of the hinge mount. Conventional practice calls for removal of the door and hinge, followed by separately straightening the bent panel and the hinge, if bent, back to their original, intended shape and relationship, as shown in FIG. 3. In General Motors vehicles, the procedure is especially difficult. It necessitates first removing the door to reach bolts in the hinge well on the outer side of the hinge mount. Then, the kick panel or inner wall in front of the door must be removed to reach a bolt extending in the opposite direction from behind the panel on which the hinge is supported. The General Motors flat rate book allows 30 minutes for this procedure, but experience has it proven that it ordinarily takes about an hour.

Another approach to aligning the sprung vehicle doors comprises opening the door, placing a block of wood between the door and door frame, and forcing the door toward a closed position, against the block. The object of this effort is to spring the hinge and door frame back to a position that will allow the door to close. However, this approach typically does not bend the hinge and door frame back to their original position, and so usually fails to accurately align the door with the door frame.

Hinge adjusting tools for use in adjusting conventional cabinetry hinges are disclosed in U.S. Pat. Nos. 3,332,274 to Dunster and 3,965,720 to Goodwin, et al. None of these tools appears to be useful for aligning sprung vehicle door hinges.

Wheel rim straightening tools are disclosed in U.S. Pat. Nos. 1,326,907 to Bond and 1,344,533 to Cole. U.S. Pat. No. 2,772,587 to Woodring, et al proposes a pair of tools which are used together for opening and closing chain links. U.S. Pat. No. 3,902,350 to McManus discloses a sheet material bending and forming tool. None of these patents discloses a tool which is used for straightening sprung vehicle door hinges. Each of these patents discloses a tool having a head mounted on a handle, the head being shaped to provide a channel for receiving or engaging an area of sheet metal, so that, by rotation of the handle, the metal can be bent. However, none of these tools appear to be capable of being used for aligning vehicle doors and, heretofore, no such tool has been known, used or suggested for use in alignment of sprung vehicle door hinges.

Accordingly, a need remains for a simpler, less time-consuming method of aligning vehicle door hinges.

SUMMARY OF THE INVENTION

One object of the invention is to align a sprung vehicle door with its frame without disassembly or removal of the door from the vehicle.

Another object of the invention is to simplify and shorten the time required for aligning a sprung vehicle door, including straightening a bent door hinge and supporting door frame.

A further object is to align vehicle doors as aforesaid without sacrifice of accuracy in alignment.

The foregoing objects are realized in a method of aligning sprung vehicle door without removing the door from its hinge, or the hinge and door from the vehicle door frame. This method comprises opening the vehicle door, positioning a prying tool having a head means for engaging the hinge between the door and door frame, engaging a portion of the hinge fixed to the door frame in the head means, and rotating the tool in a direction of closure of the door so as to bend one of the hinge and door frame to a predetermined alignment position.

A vehicle door aligning tool for carrying out the aforementioned method comprises a specialized form of handle and head. The handle is arranged to extend laterally behind the vehicle door when the head of the tool is fitted on the hinge mount. Such a handle preferably includes an elongated handle portion and a relatively much shorter end portion obtusely angled from the handle portion. The head is shaped to define a channel for receiving an exposed margin or flange of a hinge mount to rigidly engage the hinge. The head member is positioned on the end portion of the handle member so that the side walls of the channel are oriented generally normal to such end portion. The channel has an entrance opening in a direction radially of the end portion which is opposite the direction in which the handle portion is angled from the end portion. The handle thus extends laterally around and behind an open door of a vehicle to enable inserting the head between the door and door frame for engaging the hinge mount and to afford the user room to actuate the tool between the open door and the vehicle frame. Moving the handle toward the vehicle in the direction of closure of the vehicle door pries the hinge mount and connected door frame portion oppositely of the direction in which it was sprung and thereby realigns the door with its frame.

The foregoing and other objects, features and advantages of the invention will become more readily apparent from the following detailed description which proceeds with reference to the accompanying drawing.

BRIEF DESCRIPTION OF DRAWINGS

FIG. 1 is a perspective view of a portion of a vehicle door frame and door hinge mount, with the door and part of the hinge removed for clarity, together with a door hinge alignment tool in accordance with the invention.

FIG. 2 is a horizontal sectional view taken along lines 2—2 in FIG. 1, showing the vehicle door, hinge and a portion of the door frame in a sprung condition, with the tool of the invention positioned on the hinge mount for repairing the sprung frame portion and hinge, the remainder of the door frame being shown in phantom lines.

FIG. 3 is a view similar to FIG. 2 showing the door frame and hinge returned to their original, intended position by use of the tool of the invention, alternative forms of the handle shown in phantom lines.

FIG. 4 is an enlarged view of a portion of FIGS. 2 and 3, showing details of the structure of the head of the tool in relation to various elements of the door hinge shown in phantom lines.

DETAILED DESCRIPTION

Referring to FIGS. 1 and 2, a door hinge alignment tool 10 comprises a handle 12, including an elongated handle portion 14 and relatively short end portion 16, upon which is mounted a head 18. The handle has an overall length, for example, 2½ feet, sufficient to provide leverage at the head member for bending a sheet metal vehicle door frame in the manner described hereinafter. Suitably, such handle is made of a steel rod of about one inch in diameter. The end portion 16 of the handle is about four inches long and is integrally connected to the straight handle portion 14 at an obtuse angle 20 of about 130°.

The head 18 is connected to the end of handle portion 16. Referring to FIGS. 1 and 4, the head of the tool is a generally J-shaped member defined by a flat member 22, a base member 24 connected to an end of the flat member, and a hook member 26 formed at the end of the base member opposite member 22 and spaced therefrom to define a channel 28. Members 22, 24, 26 are mutually positioned at right angles so that channel 28 has a rectangular cross section and a flat bottom 30. The head has upper and lower sides 32, 34 spaced laterally of the handle to define the lengths of channel 28 and of members 22, 24, 26. The end portion 16 of the handle is connected to member 22 at a position centered between faces 32, 34. It is also positioned at the end of member 22 adjacent base member 24, so that the centerline 36 of end portion 16 is approximately aligned with the bottom 30 of channel 28. Preferably, head 18 is integrally forged of high strength steel, and welded to end portion 16.

In general, the head of the tool is sized and arranged to engage vehicle door hinge 40, without removal of the door 42 or other disassembly of the hinge or door frame. Door hinge 40 includes a hinge mount 41 connected to a sheet metal panel 44, forming a portion of the door frame, by means of three bolts 46, 48, 50. When the door and hinge are sprung, as shown in FIG. 2, panel 44 is typically bent inwardly in region 52 at the frontal end of the hinge mount and pulled outwardly in region 54 at its rearward end.

Conventional repair techniques call for removal of bolts 46, 48, 50. To do so requires removal of door 42 by detachment from the hinge at bolts 56, 58. Access to these bolts in turn requires removal of an interior panel (not shown) defining the inner side wall 60 of door 42. The door must be removed because the leading margin 62 of its outer panel obstructs access to bolts 46, 48. Removal of such bolts, and of bolt 50, also requires removal of a kick panel 63 on the interior of the vehicle. Upon completion of the repair, the foregoing steps must be reversed to reassemble the door, hinge and frame assembly.

The present invention eliminates the need for performing the steps of the foregoing paragraph. The head 18 of tool 10 is sized and arranged to fit upon a marginal portion or flange 64 of hinge mount 40, which is or is supposed to be oriented at a right angle to panel 44. Channel 28 has a length extending normal to the end portion 16 of the handle and an opening extending radially thereof so that the tool can fit over flange 64 in a lateral movement as indicated by arrow 66 in FIG. 1. The head member has a width 68, measured lengthwise of the channel between end faces 32, 34 of, for example, of two inches, sufficient to span most of the vertical dimension of flange 64. Referring to FIG. 4, channel 28 has a width 70 sufficient to snugly fit the thickness of flange 64, for example 0.3125 inches. A suitable depth for channel 28, indicated by arrow 72, is 0.25 inches. Flat member 22 has a length 74, for example two inches, which extends along most of the length of flange 64. These dimensions enable transfer of torque from the handle into the hinge mount 40 without distorting the shape of flange 64.

The head of the tool is sized and shaped to clear various elements of the door and hinge structure as it is fitted on the hinge mount and thereby avoid removing the door or hinge or both. First, the hook member 26 has a length 76 measured from its distal end face 80 to the bottom face 82 of base member 24 which is less than the spacing 84 between the head of hinge bolt 58 and the edge of flange 64, for example, about 0.625 inches. Similarly, to provide clearance from hinge pin 86, the frontal face 88 of hook member 26 is spaced a predetermined distance 90, for example, between 0.6 and 0.7 inches, from the back wall of the channel defined by the face of member 22 opposite handle 12.

OPERATION

Repairing a sprung vehicle door, hinge and frame using tool 10 is a relatively simple procedure and can be performed in only a minute or two, as opposed to about an hour for the prior art procedure. Referring to FIGS. 1 and 2, the vehicle door is opened and the tool is positioned between the vehicle door and the door frame. The end portion 16 and head 18 are aligned with hinge 40 and the elongated handle portion 14 is positioned so as to extend horizontally and laterally of the vehicle behind door 42. The tool is moved forwardly of the vehicle toward the hinge, with the hook member 26 passing between flange 64 and bolt 58 until member 22 abuts against flange member 64. Then, the tool is moved laterally a short distance toward the vehicle in the direction of arrow 66 to seat flange 64 in channel 28. When this is done, the elongated handle portion 14 is angularly positioned about equidistantly between the door and door frame, as shown in FIG. 2.

Next, the handle portion of the tool is rotated rearwardly of the vehicle, in the direction of closure of door 42, as indicated by arrow 92. Torque thereby applied through head member 18 is transferred through hinge mount 40 to bend the vehicle door frame panel 44 outwardly in region 52 and inwardly in region 54, as indicated by arrows 94, 96 respectively. This step is continued until the hinge and door frame are returned to their original, intended positions, as shown in FIG. 3.

The lateral angle of the handle member behind the open vehicle door provides room for the user of the tool to position himself between the end of the handle portion and the door and to push the handle toward the vehicle without interference from the rear portion of the door frame (not shown). A variety of handle configurations other than the particular preferred configuration disclosed herein can be used. For example, referring to FIG. 3, the handle can be positioned as indicated by handle 14*a* in dashed lines with its end portion substantially parallel to the base portion 24 of the head member. Different angles 20 between the end portion and handle portion of the handle can also be used. Also, as illustrated in FIG. 3, a straight handle member 14*b* obtusely angled from the plane of base member 24 so as to extend at a lateral angle behind open door 42 could alternatively be used.

Having illustrated and described the principles of my invention in a preferred embodiment and variations thereof, it should be apparent to those skilled in the art that the invention may be modified in arrangement and detail without departing from the principles thereof.

I claim as my invention all modifications coming within the scope and spirit of the following claims:

1. A method of aligning a sprung vehicle door frame and hinge assembly including a hinge mount connected to the frame without removing the door and its hinge from the vehicle door frame, the hinge mount having a flange portion of a fixed width, the method comprising:

opening the vehicle door;

providing a prying tool having an elongated handle and J-shaped head means mounted on an end of the handle defining a channel for engaging an exposed margin of the flange portion of said hinge mount contiguously along most of the width of the flange portion for prying the hinge mount without deforming the engaged flange portion;

sizing an end of the head member remote from the handle to fit between the flange portion of the hinge mount and an adjacent periphery of the door;

positioning the prying tool between the door and door frame including inserting said end of the head member between the flange portion and the adjacent door periphery;

engaging the margin of the flange portion of said hinge mount in the channel of the head means; and rotating the tool about the hinge in a direction of closure of the door to pry the hinge mount so as to bend said door frame to a predetermined alignment position without deforming the flange portion.

2. A method according to claim 1 wherein the tool has an elongated handle, the positioning step including positioning the tool with its handle extending laterally of the vehicle behind the vehicle door.

3. A method according to claim 2 in which the positioning step further includes positioning the tool so that the handle is angularly positioned approximately midway between the open vehicle door and the vehicle door frame.

* * * * *